US006079587A

United States Patent [19]

Vogt

[11] Patent Number: 6,079,587

[45] Date of Patent: Jun. 27, 2000

[54] SLOPING CONTAINER BOTTOM WITH DRAIN

[75] Inventor: Randall L. Vogt, Plymouth, Nebr.

[73] Assignee: Plymouth Manufacturing, Inc., Plymouth, Nebr.

[21] Appl. No.: 09/232,407

[22] Filed: Jan. 15, 1999

[51] Int. Cl.[7] ..... B65D 1/34

[52] U.S. Cl. ..... 220/571; 220/608

[58] Field of Search ..... 220/571, 573, 220/608, DIG. 6

[56] References Cited

U.S. PATENT DOCUMENTS

| | | | |
|---|---|---|---|
| D. 143,128 | 12/1945 | Butler . | |
| 1,576,319 | 3/1926 | Fagley . | |
| 1,584,175 | 5/1926 | Irons . | |
| 3,884,383 | 5/1975 | Burch et al. | 220/72 |
| 4,150,763 | 4/1979 | Simpson | 220/90 |
| 4,651,887 | 3/1987 | Patrick | 220/1 |
| 4,733,790 | 3/1988 | Stein | 220/23.83 |
| 4,746,034 | 5/1988 | Ata et al. | 222/143 |
| 4,767,021 | 8/1988 | Pies | 220/465 |
| 4,782,973 | 11/1988 | Wiese | 220/68 |
| 5,018,559 | 5/1991 | Branan | 141/339 |
| 5,161,690 | 11/1992 | Foshaug | 206/512 |
| 5,253,777 | 10/1993 | Schultz | 220/571 |
| 5,285,914 | 2/1994 | Del Zotto . | |
| 5,292,024 | 3/1994 | Koefelda et al. | 220/608 |
| 5,316,174 | 5/1994 | Schutz | 220/571 |
| 5,333,752 | 8/1994 | Harding, Jr. | 220/565 |
| 5,346,094 | 9/1994 | Strawser | 220/571 |
| 5,392,945 | 2/1995 | Syrek | 220/608 |
| 5,402,909 | 4/1995 | Cramer et al. | 220/601 |
| 5,449,087 | 9/1995 | Mikula et al. | 220/608 |
| 5,615,798 | 4/1997 | Luburic et al. | 220/572 |
| 5,662,237 | 9/1997 | Cain | 220/368 |
| 5,718,351 | 2/1998 | Rude | 220/571 |
| 5,908,133 | 6/1999 | Luburic et al. | 220/572 |

*Primary Examiner*—Stephen Castellano
*Attorney, Agent, or Firm*—Kinney & Lange, P.A.

[57] ABSTRACT

The present invention relates to an easily drained bulk container bottom. The container bottom of the present invention has a planar bottom wall which slopes downward from a high region to an opposite, low region. The bottom wall slopes in one plane and surrounds a raised dome which is generally centrally located in the container bottom. The drainage opening is positioned adjacent the low region to facilitate complete drainage of the container. Fluids run off the raised dome and follow the downward slope of the planar bottom wall from the high region to the opposite, low region, and then out the drainage opening.

24 Claims, 2 Drawing Sheets

10
3
14
22
20
18
28
16
12
3

10
20
32
14
24
12
30
22
26
28
18
16
12
24
26
20

SLOPING CONTAINER BOTTOM WITH DRAIN

BACKGROUND OF THE INVENTION

The present invention relates to bulk containers for storing and transporting large volumes of fluid. Specifically, the present invention relates to a one-piece bulk container bottom that will drain completely without being tipped, and that has the strength and durability to endure the stresses associated with transporting, repeated loading and rough handling of the container.

Bulk containers are used to store and transport large volumes (hundreds of gallons) of fluid. The fluids stored and transported may be hazardous, corrosive or otherwise difficult to handle. Each time the container is drained, it is important to completely remove what residual fluid has clung to the features of the container before the container is reused. The size and weight of intermediate bulk containers make tipping or shaking the container to facilitate complete drainage extremely awkward. Ideally the container geometry maximizes the drainage of those fluids contained within without requiring the container to be tipped or moved. The more completely a container drains, the less time is spent cleaning the container between uses.

Because these containers are large, awkward and weigh thousands of pounds when full, they are typically moved and handled using heavy machinery such as a forklift. Such handling cannot be described as delicate. As a result, bulk containers must be able to stand up to an occasional offensive touching from the prong of a forklift without diminishing their drainage efficiency. Container bottoms ideally have few features which hang below the container floor and which would interfere with forklift handling. Containers that do not have these features are both easier and safer to handle.

Prior container bottoms that were constructed of two or more parts welded together had an increased chance of cracking at the welded seams because of cyclic stresses the container is exposed to over time. Similarly, any creased or sharply angled portions of a container bottom are prone to failure due to cyclic stresses.

Prior bulk containers with flat bottoms had a tendency to sag after numerous loadings or under the weight of a full load of fluid. Sagging made these containers prone to failure and made them difficult to drain completely.

Some prior containers had raised centers and discrete fluid pathways, formed canals or cut channels which directed fluids to a drainage opening and thereby were intended to improve the drainage characteristics of the container. Such drainage pathways were typically formed below the elevation of a container bottom and therefore prone to be deformed by rough handling of the container by forklift. Sharp edges and creases associated with these features in prior container bottoms allow fluids contained therein to cling to the container bottom rather than to drain through the drainage opening. Fluid left behind after the container is drained increases the time it takes to clean and prepare the container for its next use.

BRIEF SUMMARY OF THE INVENTION

The present invention provides a simple one-piece container bottom that assures complete drainage of its contents, and stands up to the vigors of repeated loading and forklift handling.

The one-piece container bottom of the present invention includes a generally planar sloped bottom wall. The sloped bottom wall slopes from a high region on one side of the sloped bottom wall to an opposite low region. The generally planar bottom wall portion also has a generally centrally positioned raised dome. The one-piece container bottom has an outer edge which surrounds the planar bottom wall portion and extends upwardly from the planar bottom wall portion. The drainage opening for the one-piece container bottom is adjacent the lower region of the bottom wall portion. Fluid in the container drains off the generally centrally located raised dome and from the high region of the bottom wall to the opposite, low region of the bottom wall where the drainage opening is located.

BRIEF DESCRIPTION OF THE DRAWINGS

The present invention will be further explained with reference to the drawing figures listed below, wherein like structure is referred to by like numerals throughout the several views.

While the above-identified drawing figures set forth one preferred embodiment of the invention, this disclosure is intended to present the invention by way of representation and not limitation. It should be understood that numerous other modifications and embodiments can be devised by those skilled in the art which follow the scope and spirit of the principles of this invention.

DETAILED DESCRIPTION

In describing the invention, specific terminology will be used for the sake of clarity. The invention, however, is not intended to be limited to the specific terms selected, and it is to be understood that each term selected includes all the technical equivalents that operate similarly.

Intermediate bulk containers are designed to store and transport hundreds of gallons of fluid in one container. Because of the heavy loads associated with these volumes of fluid, it is not practical to tip or move the container to facilitate drainage of the fluid through a drainage hole. Containers with complicated bottoms including canals or other drainage features can increase the likelihood that a fluid may cling to the contours of the canal or crease and that these features of the container bottom may be damaged by rough handling.

Figure 1:
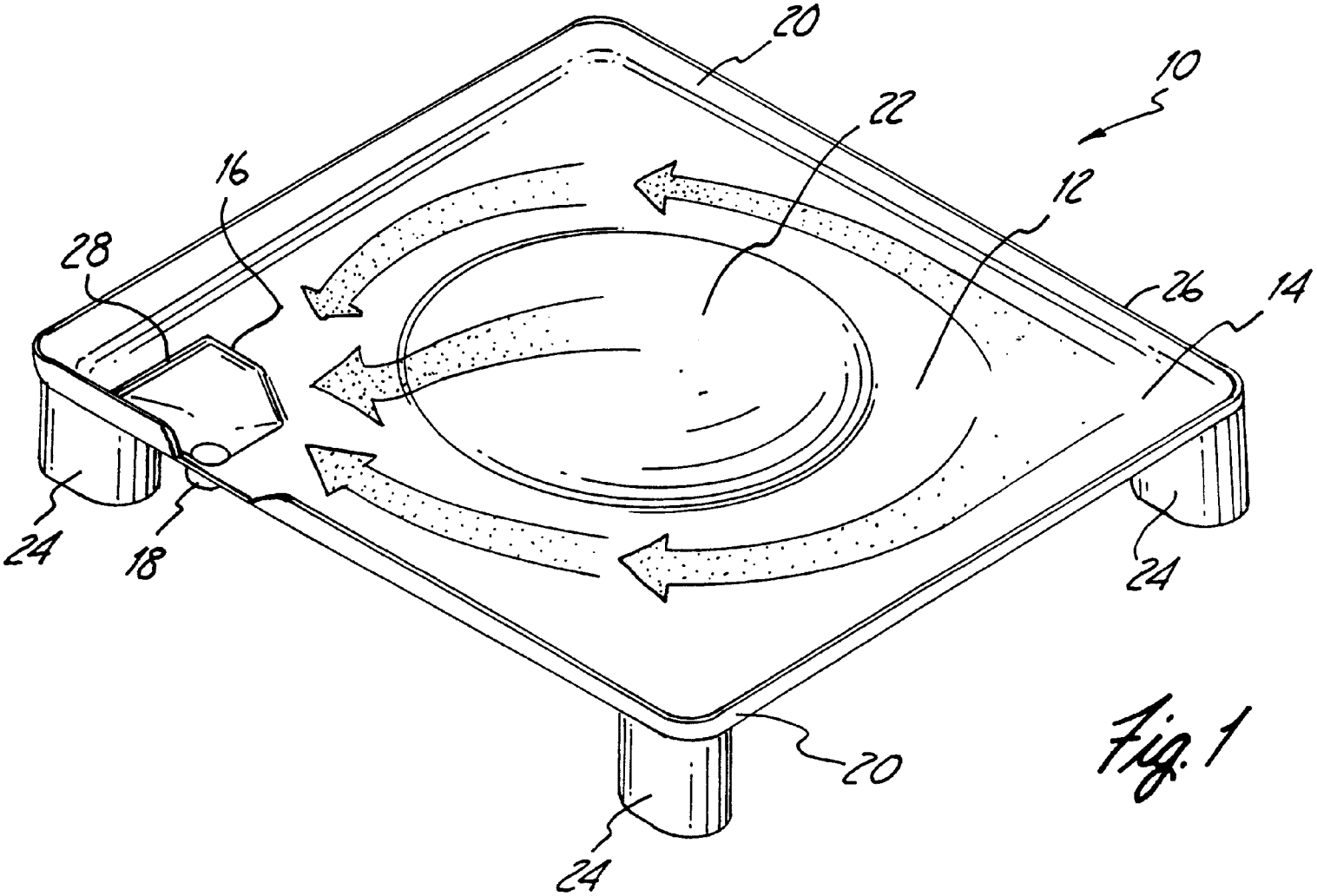
FIG. 1 is a perspective view of a container bottom according to the present invention.

A container bottom 10 with superior drainage characteristics and durability according to the present invention is shown in perspective in FIG. 1. Container bottom 10 according to the present invention has planar bottom wall 12 which slopes downwardly, in one plane, from high region 14 to and opposite low region 16. Drainage opening 18 is located adjacent low region 16. Bottom wall 12 extends upwardly to form outer edge 20 of container bottom 10. Raised center dome 22 is draw formed in bottom wall 12 at a generally central location. Raised center dome 22 directs fluids onto the planar bottom wall 14. Both raised dome 22 and the downward slope from high region 14 to opposite, low region 16 direct fluid toward drainage opening 18 without tipping the container itself.

Because container bottom 10 simply slopes in one plane, container bottom 10 has no features on which fluid can cling. In addition to deflecting fluid onto planar bottom wall 12, raised dome 22 counters the weight of the contained fluid to prevent sagging of container bottom 10. Formed raised dome 22 elastically deflects under the weight of fluid in the container, but snaps back as the fluid drains from the container. The one-piece draw form shape of the container bottom has no seams or channels which are prone to stress cracking over time and allow residual fluid to cling to a container bottom.

Preferably, the one-piece container bottom is integrally formed from one piece of metal (e.g., stainless steel to mitigate corrosive effects of fluids which may be contained in the immediate bulk container). Other materials can be used to form the container bottom, such as suitable polymers, polymeric composites, carbon steel, or aluminum.

Container bottom 10 is supported by legs 24 which are preferably situated only around the perimeter of the container bottom 10. Because bottom wall 12 slopes, legs 24 are of differing lengths (the longest leg being under the high region, the shortest leg being under the low region, and so on). Top edge 26 of outer edge 20 is finished to be parallel to the top of the container, and is formed to be sealably bonded or joined to container walls during fabrication of the container.

Figure 2:
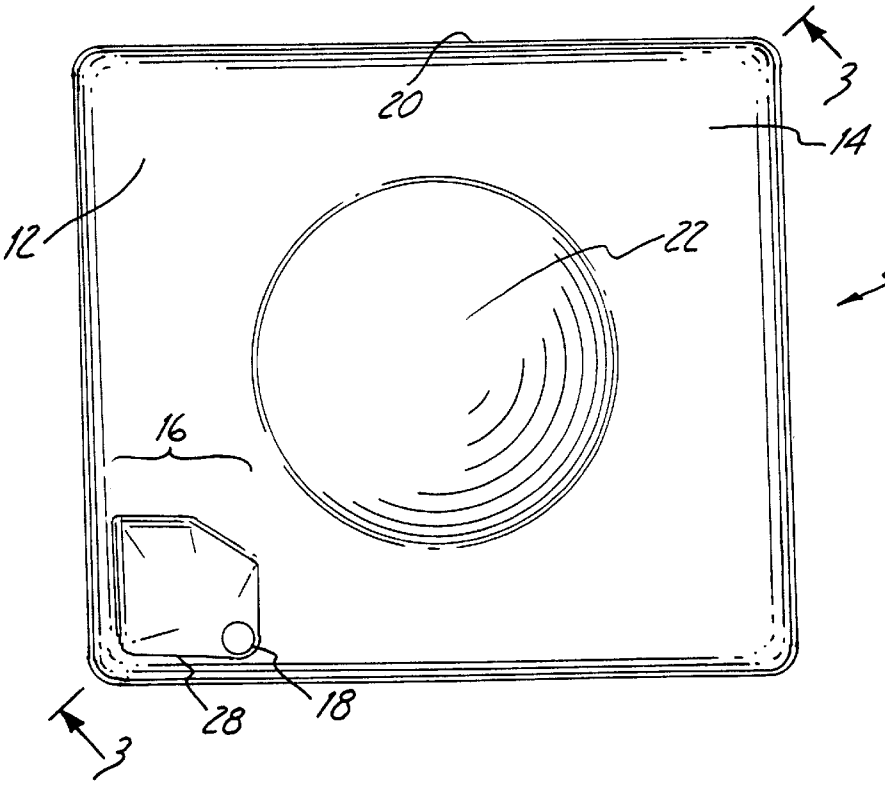
FIG. 2 is a top plan view of a container bottom according to the present invention.
Figure 3:
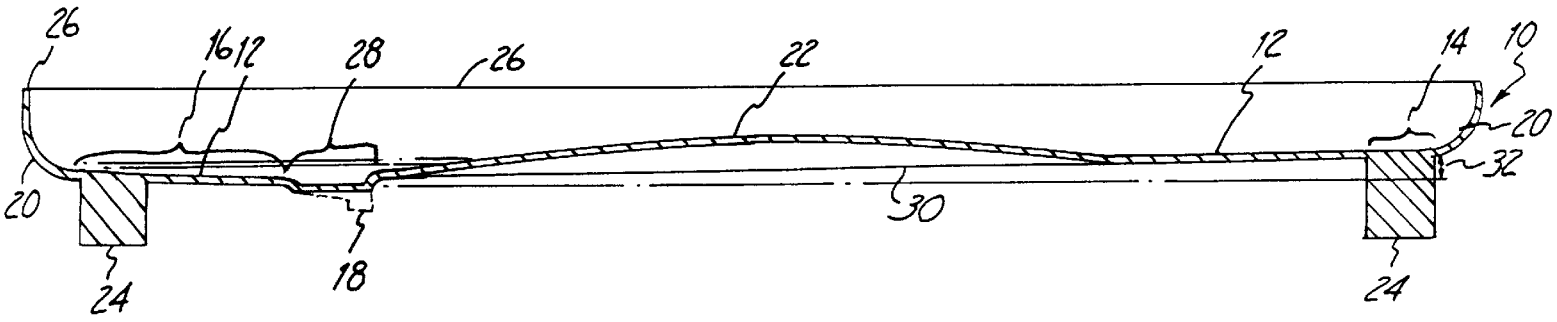
FIG. 3 is a sectional view along the section marked 3—3 in FIG. 2.

As shown in FIG. 1, sump 28 is positioned adjacent low region 16 to further facilitate complete drainage of the container bottom. Sump 28 and drainage opening 18 are also positioned so as not to interfere with legs 24. Preferably drainage opening 18 is positioned in a corner of sump 28 and away from the corner of container bottom 10, as seen in FIGS. 1–3. Positioning the drainage opening in this way mitigates any deformation adjacent formed sump 28 (due to repeated loading of container bottom 10 which may allow fluid to collect adjacent the sump). In this way, drainage opening 18 and sump 28 further encourage complete draining of the container bottom of the present invention.

As seen in FIG. 2, outer edge 20 is generally rectangular and raised dome 22 is positioned generally centrally within outer edge 20 within its outer circumference spaced apart from outer edge 20 by a distance of about equal to the radius of raised dome 22. In a preferred embodiment container bottom 10 is about 42 inches by 48 inches, and the radius of raised dome 22 is about 12 inches. Configuring raised dome 22 in this way provides for a gentle transition between the raised dome portion and the sloped planar bottom wall 12.

Container bottom 10 according to the present invention is not limited to the above mentioned dimensions. For example, container bottom 10 may be 42 inches by 42 inches, or 44 inches by 52 inches. In addition, container bottom 10 may be round rather than rectangular or square, or may assume other shapes.

The plane defined by bottom wall 12 is illustrated by plane 30 in FIG. 3. The downward slope from high region 14 to low region 16 has rise 32 in the range of about ½ to two inches. Raised dome 22 rises from planar bottom wall 12 a distance in the range of about ¼ inch to 2 inches. Preferably, outer edge 20 curves upwardly from bottom wall 12 with a radius in the range of one to three inches. Sump 28 sinks in the range of an additional ⅛ inch to ½ inch below bottom wall 12 to facilitate drainage of fluid into drainage opening 18. Fluid generally moves away from, and off of, raised dome portion 22 onto planar bottom wall 12, and from high region 14 on planar bottom wall 12 to low region 14 on planar bottom wall 12, into adjacent sump 28 and out drainage opening 18. The simple form of container bottom 10 facilitates drainage without complicated fluid pathways which have an affinity for clinging fluid, which is particularly a problem for high-viscosity fluids. The container bottom of the present invention has virtually no downwardly extending protuberances that can interfere with careful, if not elegant, handling of the container with forklifts.

Although the present invention has been described with reference to preferred embodiments, workers skilled in the art will recognize that changes may be made in form and detail without departing from the spirit and scope of the invention. For example, the container bottom of the present invention can assume other shapes, such as, for example, a circle or a trapezoid. Similarly, the raised center dome can have various shapes. In addition, the container bottom of the present invention may be fashioned out of a number of materials such as plastic, carbon fiber, ceramic or any combination of these materials. Further, the sump may be configured in a variety of ways. For example, the sump may have a circular shape, or it may be positioned nearer or farther from the legs supporting the container. Further the outer edge of the container bottom may be further extended upwardly to form the sides of the bulk container.

What is claimed is:

1. A one-piece bottom for a fluid container comprising:

a bottom wall, the bottom wall being aligned to slope from a high region on one side thereof to a low, opposite region and having a generally planar wall portion which surrounds a generally centrally aligned raised dome formed on an inner surface of the bottom wall;

an outer edge portion surrounding the generally planar wall portion of the bottom wall and formed to extend upwardly therefrom; and a drainage opening extending through the bottom wall adjacent the low region thereof.

2. The one-piece bottom of claim 1 wherein the outer edge portion defines a generally rectangular shape and the high region and the low region are at opposite corners of the rectangular shape.

3. The one-piece bottom of claim 1 wherein the bottom wall has a formed sump adjacent the low region, and wherein the drainage opening is positioned within the sump.

4. The one-piece bottom of claim 1 wherein the outer edge portion has a generally rectangular shape and the high region and the low region are at opposite corners of the generally rectangular shape.

5. The one-piece bottom of claim 1 wherein the outer edge curves upwardly from the generally planar wall portion of the bottom wall.

6. The one-piece bottom of claim 6 wherein the outer edge portion has an upward curve having a radius of about 1 to 3 inches.

7. The one-piece bottom of claim 1 wherein the high region is about ½ to 2 inches higher than the low region.

8. The one-piece bottom of claim 1 wherein the sump has a depth of about ⅛ to ½ of an inch.

9. The one-piece bottom of claim 1 wherein the raised dome has a height of about ¼ to 2 inches.

10. The one-piece bottom of claim 1 wherein the one-piece bottom is formed of a metallic material.

11. The one piece bottom of claim 10 wherein the metallic material is stainless steel, carbon steel, or aluminum.

12. The one-piece bottom of claim I wherein the raised dome portion has an outer peripheral edge defining an outer circumference, which is spaced apart from the outer edge portion by a distance of at least approximately the radius of the outer circumference of the raised dome portion.

13. The one-piece bottom of claim 1 wherein the raised dome portion has a circular outer peripheral edge with a diameter of about 24 inches.

14. A one-piece bottom for a fluid container comprising:

a bottom wall, the bottom wall being aligned to slope from a high region on one side thereof to a low, opposite region and having a planar wall portion which surrounds a generally centrally aligned raised dome formed on an inner surface of the bottom wall;

an outer edge portion surrounding the planar wall portion and formed to extend upwardly therefrom;

a sump formed adjacent the low region of the bottom wall; and a drainage opening positioned within the sump extending through the bottom wall adjacent the low region thereof, wherein the drainage opening is positioned in a corner of the sump, the corner located adjacent the outer edge of the container bottom.

15. A method for forming a one-piece bottom for a fluid container, the method comprising:

providing a sheet of material;

forming the sheet of material to define an upwardly extending outer edge;

forming the sheet material to provide a raised generally central dome portion surrounded by a generally planar portion, the planar portion sloping from a high region adjacent a first area of the outer edge to a low region adjacent a second opposite area of the outer edge; and providing a drainage opening adjacent the low region of the generally planar portion.

16. The method of claim 15 wherein the outer edge portion is formed in a generally rectangular shape and the high region and the low region are defined at opposite corners of the rectangular shape.

17. The method of claim 16 further comprising:

forming a sump adjacent the low region; and positioning the drainage opening within the sump.

18. The method of claim 15 wherein the high region is defined as about ½ to 1 inch higher than the low region.

19. The method of claim 15 wherein the outer edge portion is formed to have an upward curve having a radius of about 1 to 3 inches.

20. The method of claim 15 wherein the sump has a depth of about ⅛ to ½ inch.

21. The method of claim 15 wherein the raised dome has a height of in the range of about ¼ inch to 2 inches.

22. The method of claim 15 wherein the one-piece container bottom is formed from a metallic material.

23. The method of claim 22 wherein the metallic material is stainless steel, carbon steel, or aluminum.

24. A method for forming a one-piece bottom for a fluid container, the method comprising:

providing a sheet of material;

forming the sheet of material to define an upwardly extending outer edge;

forming the sheet of material to provide a raised generally central dome portion surrounded by a generally planar portion, the planar portion sloping from a high region adjacent a first area of the outer edge to a low region adjacent a second opposite are of the outer edge, wherein the outer edge portion is formed in a generally rectangular shape and the high region and the low region are defined at opposite corners of the rectangular shape;

forming a sump adjacent the low region;

providing a drainage opening adjacent the low region of the generally planar portion; and positioning the drainage opening within a corner of the sump, the corner located adjacent to the outer edge of the container bottom.

* * * * *